US005877096A

United States Patent [19]

Stevenson et al.

[11] Patent Number: 5,877,096

[45] Date of Patent: Mar. 2, 1999

[54] NON-WOVEN NEEDLE-PUNCHED FILTER FABRIC

[75] Inventors: Peter Edward Stevenson, Easley, S.C.; Jeffrey King, Salem, Oreg.

[73] Assignee: The Tensar Corporation, Atlanta, Ga.

[21] Appl. No.: 851,271

[22] Filed: May 5, 1997

[51] Int. Cl.[6] ..... E02B 11/00

[52] U.S. Cl. ..... 442/36; 442/57; 442/383; 442/388; 428/86

[58] Field of Search ..... 442/36, 57, 383, 442/388; 428/86

[56] References Cited

U.S. PATENT DOCUMENTS

| | | | |
|---|---|---|---|
| 4,840,832 | 6/1989 | Weinle et al. | 428/156 |
| 5,104,703 | 4/1992 | Rachman et al. | 428/35.6 |
| 5,167,764 | 12/1992 | Nielsen et al. | 162/146 |
| 5,167,765 | 12/1992 | Nielsen et al. | 162/146 |
| 5,277,520 | 1/1994 | Travis | 405/128 |
| 5,322,581 | 6/1994 | Heerten et al. | 156/148 |
| 5,380,582 | 1/1995 | Neely, Jr. et al. | 428/220 |

OTHER PUBLICATIONS

Dialog Literature Search on "Needle Punch" for drainage composite fabric.

*Primary Examiner*—Christopher Raimund
*Attorney, Agent, or Firm*—Jacobson, Price, Holman & Stern, PLLC

[57] ABSTRACT

A non-woven needle-punched filter fabric for use in a geocomposite having a filter face and a laminating face, the fabric having a first filter and cushion zone adjacent the filter face produced from spun bond, continuous filament, a second stiff and bend resistant zone adjacent the first zone produced from a blend of staple non-fusible fiber and staple fusible fiber, and a third zone at the laminating face produced from fiber from both the first and second zones whereby the third zone has a hairy characteristic which facilitates laminating the fabric to a drainage net or a geogrid.

11 Claims, 2 Drawing Sheets

NON-WOVEN NEEDLE-PUNCHED FILTER FABRIC

FIELD OF THE INVENTION

This invention relates to a non-woven needle-punched filter fabric or geotextile. The non-woven geotextile may be bonded to one or both sides of an integral net structure such as a drainage net. Drainage nets are typically manufactured of polymers that resist compression and provide reliable flow capacity for fluids or gases encountered in waste containment facilities. They are ideally suited for leachate and gas collection and leak detection systems. The drainage composites provide both filtration and drainage with easy installation and high reliability. The non-woven geotextile also may be bonded to one or both sides of a geogrid. The geogrid composites are ideally suited for waste containment structures, backfill barriers, and silt barriers in construction and mining applications. In waste containment and backfill barriers, the geogrid composite is used to reinforce a containment structure. Its principal function is to strengthen the structure by reinforcement while also allowing some horizontal drainage to dewater the structure.

BACKGROUND OF THE INVENTION

A geocomposite is manufactured by laminating a geotextile onto one or both sides of an integral net structure. The typical geotextile is not specially manufactured for this end use. Instead, the geotextiles used in geocomposite manufacture are general purpose products not specially designed or manufactured for use in geocomposites. A typical geotextile used for this application is a continuous filament, polyester, non-woven needle-punched fabric.

The conventional geocomposite has several deficiencies. First, the bond of the fabric to the net structure may be inadequate. Second, the fabric frequently inhibits or reduces flow due to undesired sagging of the fabric into the channel when the product is placed under a load. Third, the filtration characteristics of the fabric are not ideally suited for certain applications. And, fourth, the cushioning effect of the fabric may be inadequate for certain applications.

SUMMARY OF THE INVENTION

It is an object of the present invention to provide a filter fabric designed to optimize the performance of a geocomposite in earthwork installations.

It is an object of the present invention to optimize the performance of a geocomposite in waste containment installations.

It is another object of the present invention to provide a filter fabric which has superior bonding capabilities to integral net structures.

It is another object of the present invention to provide a filter fabric which is resistant to sagging into the integral net structure to optimize flow performance.

It is another object of the present invention to provide a filter fabric which has superior filtration capabilities in soil types common to the earthwork construction industry.

It is another object of the present invention to provide a filter fabric which has superior cushioning effect to conventional fabrics.

In accordance with the present invention, a non-woven needle-punched fabric or geotextile is provided having a filter face and a laminating face and at least three distinct performance zones. The filter face of the fabric is designed to be placed toward the soil. The laminating face of the fabric is designed to be laminated to the integral net structure.

The first zone is a filter and cushion zone adjacent the filter face. The first zone is produced from spun bond, continuous filament which optimizes bulk for cushioning while achieving minimum open area with maximum porosity for filtration.

The second zone provides a stiff, bend resistant area in the fabric. This zone is produced from a blend of staple non-fusible fiber and staple fusible fiber, either monofilament or multifilament, which is preferably a bicomponent fiber having a low melting temperature sheath and a high melting temperature core. When the fabric is exposed to the heat of the lamination process in geocomposite manufacture, the fusible fiber melts, flows around the mixture of fiber in the immediate vicinity and solidifies the adjacent area into a stiff zone in the fabric. This stiff zone resists sagging into the net structure of the final geocomposite product.

The third zone is a small fraction of the fabric and is comprised of fiber from both the first and second zones that is deliberately carried through the fabric to the laminating face to create a hairy characteristic to this face. When the fabric is laminated to the net structure, the hairy fibers are encapsulated in the softened net structure resulting in an improved bond between the fabric and the net structure.

A fourth zone also comprising a small fraction of the fabric may also be formed. The fourth zone is comprised of fiber from both the first and second zones that is deliberately carried through the fabric to the filter face to create a hairy characteristic to this face.

The filter fabric or geotextile is bonded to the net structure. This is typically accomplished by a flame method or a heated roll method.

DESCRIPTION OF THE PREFERRED EMBODIMENTS

Figure 1:
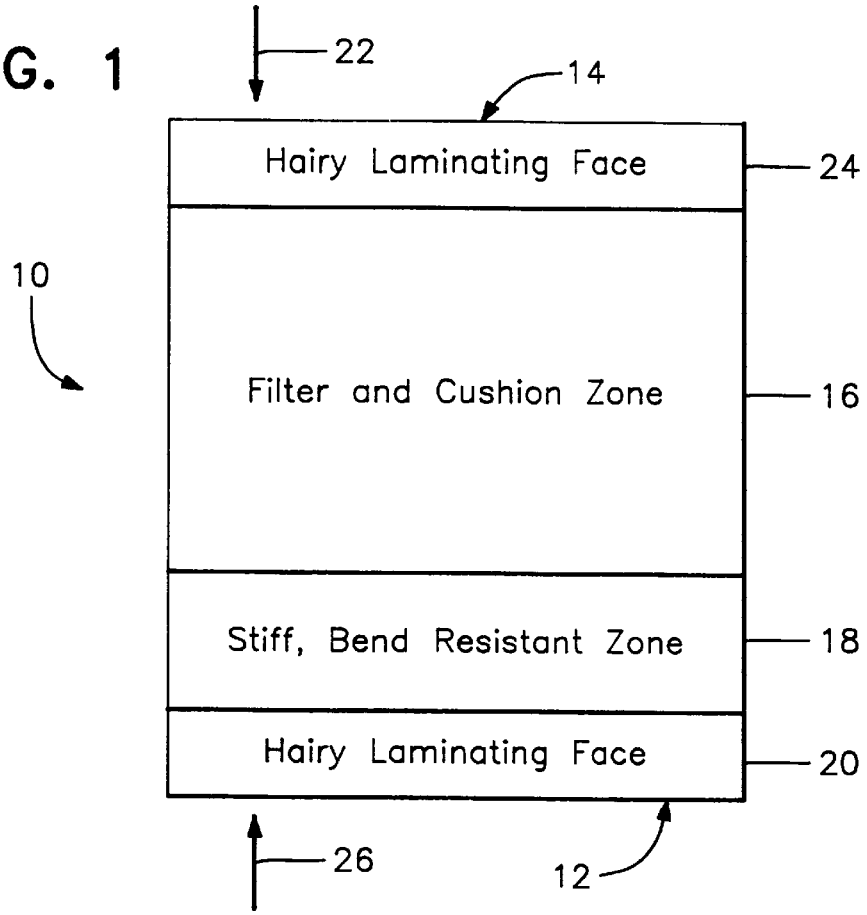
FIG. 1 is a schematic representation (not to scale) of a filter fabric of the present invention.

FIG. 1 illustrates the performance zones and construction of the filter fabric 10. The fabric 10 comprises a non-woven needle-punched fabric having a laminating f ace 12 and a filter face 14. The fabric comprises at least three distinct performance zones or regions 16, 18 and 20, respectively.

Fabric zone 16 is the filter and cushion portion of the fabric 10. Fabric zone 16 comprises up to about 85% of the total cross-sectional area of the fabric 10. Fabric zone 16 is produced from spun bond, continuous filament which optimizes bulk for cushioning while achieving minimum open area with maximum porosity for filtration. The spun bond, continuous filament is typically polyester, polypropylene, polyamide or blends thereof. The continuous filament may also be polyethylene if polyethylene is not used as the fusible fiber in fabric zone 18. The continuous filament has a denier of 2 to 15, preferably 4 to 7.

Fabric zone 18 comprises substantially the remainder, typically about 15%, of the overall structure. This zone is intended to provide a stiff, bend resistant area in the fabric. The zone is produced from a blend of non-fusible staple fiber such as polyester fiber and staple fusible fiber, either monofilament or multifilament, which is preferably a bicomponent fiber having a low melting temperature sheath and a high melting temperature core. The staple fusible fiber may be polyethylene fiber. The staple fiber has a denier of 2 to 10, preferably 3 to 8.

The staple bicomponent fiber may be one having a low melting sheath of polyethylene, polyisophthalic acid or the like, and a high melting core of polyester, polyvinylalcohol or the like. The bicomponent fiber also may be a side-by-side fiber in which two different components (one low melting and one high melting) are fused along the axis and have an asymmetrical cross-section, or a biconstituent fiber having one component dispersed in a matrix of the other component, the two components having different melting points. The low and high melting components also may be polyethylene and polypropylene, respectively, different melting point polyesters, or polyamide and polyester, respectively.

The bicomponent fiber will typically be composed of 30 to 70% by weight of the low melting component, and 70 to 30% by weight of the high melting component. Various weight ratios of staple non-fusible fiber to staple fusible fiber may be used such as 75/25, 50/50 or 25/75.

When the fabric is exposed to the heat of the lamination process, the fusible fiber melts, flows around the mixture of fiber in the immediate vicinity and solidifies the adjacent area into a stiff zone in the fabric. It is this stiff zone that resists sagging into the net structure.

Fabric zone 20 comprises only a small fraction of the total fabric and is comprised of fiber from both fabric zones 16 and 18 that are deliberately carried through the fabric to the laminating face 12 to create a hairy characteristic to this face. Fabric zone 20 is created when the fabric is needle-punched in the direction indicated by arrow 22. In this needle-punching operation, fiber from fabric zone 16 is driven into and through fabric zone 18. The fabric is needle-punched in the direction of arrow 22 at a density of 100 to 200 penetrations per square inch, preferably 125 to 150 penetrations per square inch. When the fabric is laminated to the net product, the hairy fibers are encapsulated in the soft net surface resulting in an improved bond between the fabric and the net structure.

A fourth zone 24, also comprising a small fraction of the fabric, may also be formed. The fourth zone 24 is comprised of fiber from both fabric zones 16 and 18 that is deliberately carried through the fabric to the filter face 14 with the intent of creating a hairy characteristic to this face. This zone would be created if the fabric was needle-punched not only in the direction indicated by arrow 22 but also in the direction indicated by arrow 26. The fabric is needle-punched in the direction of arrow 26 at a density of 100 to 200 penetrations per square inch, preferably 125 to 150 penetrations per square inch.

The filter fabric or geotextile is bonded to the net structure by one of two methods. The open flame method exposes both mating surfaces of the geotextile and the net product to an open flame. Immediately thereafter, the two materials are joined together in a nip roll and allowed to cool. The other method, the heated roll method, is accomplished by heating the mating faces of both the geotextile and the net structure with two heated rolls. Upon leaving the heated rolls, the mating faces are joined and the composite is allowed to cool.

Figure 2:
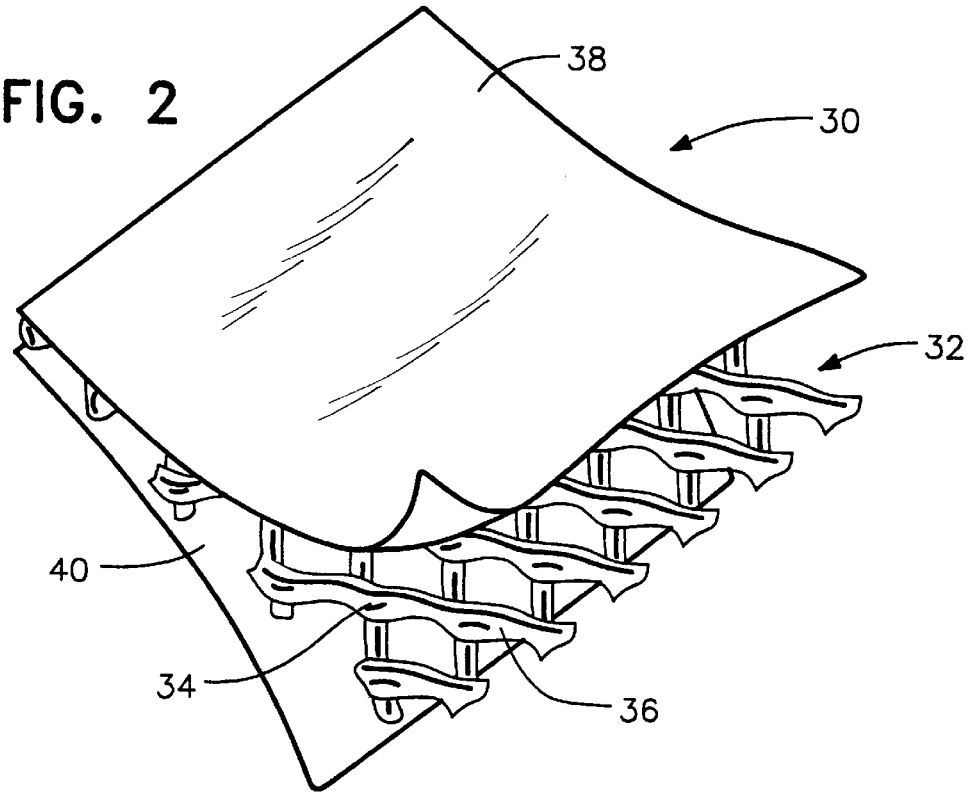
FIG. 2 is a perspective view of a geocomposite having filter fabrics of the present invention laminated to a drainage net.

FIG. 2 illustrates a geocomposite 30 having a drainage net 32 with nodes 34 and ribs 36. Two filter fabrics 38 and 40 are secured across the nodes 34 and ribs 36 of the drainage net 32.

Figures 3, 4:
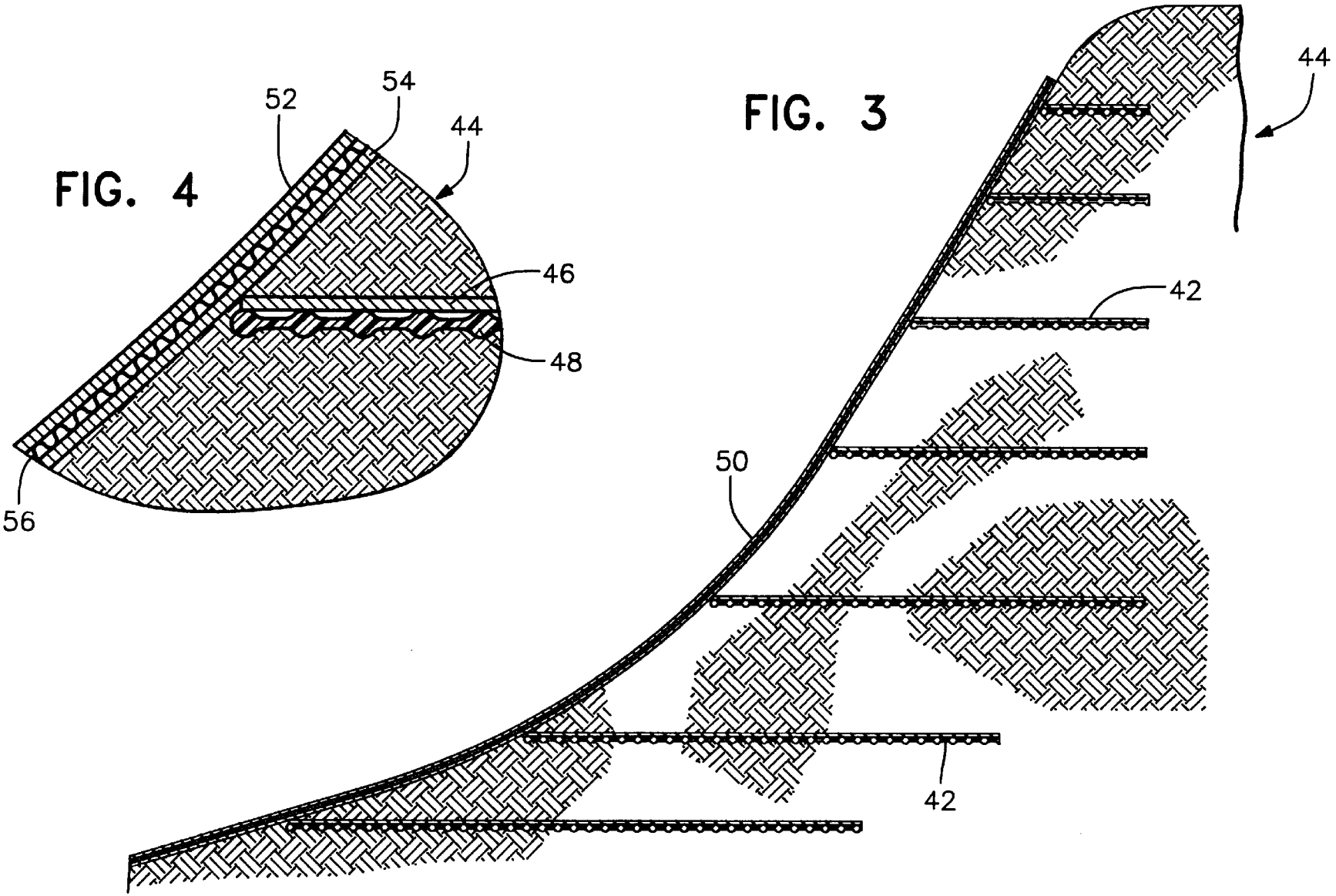
FIG. 3 is a schematic sectional view of a soil embankment using geocomposites having filter fabrics of the present invention laminated to a drainage net and to geogrids.
FIG. 4 is an exploded sectional view of a portion of FIG. 3.

FIG. 3 illustrates geocomposites 42 according to the present invention installed in a soil embankment 44. The geocomposites 42 each have a filter fabric 46 laminated to a geogrid 48. Geocomposites 42 provide a reinforcement function as well as a limited horizontal drainage function. The soil embankment 44 also has a geocomposite 50. The geocomposite 50 has two filter fabrics 52 and 54 laminated to a drainage net 56 to drain water or other fluid from the soil embankment 44.

The grid used in the geogrid composite may be a uniaxially or biaxially oriented integral structural polymer geogrid. These grids are preferably made by the process disclosed in U.S. Pat. No. 4,374,798, assigned to the Tensar Corporation of Morrow, Georgia ("Tensar"), the disclosure of which is expressly incorporated herein by reference.

While a high density polyethylene biaxial integral structural geogrid of the type produced by the process disclosed in the '798 patent and sold by Tensar as its BX 1200 geogrid is preferred, the grid may be formed of other polymeric materials, including other polyolefins, or various polyamides, polyesters or even fiberglass. Additionally, woven or knitted structural textiles such as disclosed in co-pending U.S. patent application Ser. No. 08/643,182, filed May 9, 1996, pending, and Ser. No. 08/696,603, pending, and U.S. Pat. No. 5,795,835, filed Aug. 14, 1996, assigned to Tensar, the disclosure of each of which is incorporated herein by reference, may be used as the grid element of the composite.

The geogrid composite of the present invention is also ideal for use in a wide range of applications in the mining, industrial and construction fields. An important application of the geogrid composite is in waste and containment applications. The geogrid composite may be used in the mining industry for use as a containment structure to contain and dewater waste by-products of the various types of processes utilized by the mining industry.

The geogrid composite is ideal for waste containment structures, backfill barriers, and silt barriers in construction and mining applications. In waste containment and backfill barriers, the geogrid composite is used to form a containment structure. Its principal function is to contain waste material usually consisting of a liquid with some percentage of solids.

The polymer grid is utilized to provide the strength required for the structure while the fabric "filters" the liquids involved. Typically, the containment structure is constructed utilizing the grid composite to reinforce the walls of the structure. The waste or backfill material is then placed into the structure.

The grid composite, when utilized as a silt barrier at construction sites by anchoring to the ground, performs in exactly the same manner. It is utilized in an open trench to prevent silts or other small particles from washing onto streets or in some way contaminating adjacent properties.

Having described the invention, many modifications thereof will become apparent to those skilled in the art to which it pertains without deviation from the spirit of the invention as defined by the scope of the appended claims. For example, the geogrid composite may additionally be used as further described in U.S. Pat. Nos. 5,199,825 and 5,277,520. Also, in FIGS. 3 and 4, geogrids 48 could be replaced by drainage nets to form geocomposites 42 each having a filter fabric 46 laminated to a drainage net.

We claim:

1. A geocomposite comprising an integral net structure and a non-woven needle-punched filter fabric, the fabric having a filter face and a laminating face, the fabric comprising a first filter and cushion zone adjacent the filter face produced from spun bond, continuous filament, a second stiff and bend resistant zone adjacent the first zone produced from a blend of staple non-fusible fiber and staple fusible fiber, and a third zone at the laminating face produced from fiber from both the first and second zones whereby the third zone has a hairy characteristic, the laminating face of the filter fabric being laminated to a face of the net structure.

2. The geocomposite of claim 1 wherein the continuous filament is polyester, polypropylene, polyamide or blends thereof.

3. The geocomposite of claim 1 wherein the first zone comprises up to about 85% of the total cross-sectional area of the fabric.

4. The geocomposite of claim 1 wherein the staple non-fusible fiber is polyester.

5. The geocomposite of claim 1 wherein the staple fusible fiber is polyethylene monofilament.

6. The geocomposite of claim 1 wherein the staple fusible fiber is a bicomponent fiber having a low melting fusible sheath and a high melting core.

7. The geocomposite of claim 6 wherein the bicomponent fiber is composed of 30 to 70% by weight of the low melting sheath and 70 to 300% by weight of the high melting core.

8. The geocomposite of claim 1 wherein the second zone comprises about 15% of the total cross-sectional area of the fabric.

9. The geocomposite of claim 1 further comprising a fourth zone at the filter face of the fabric produced from fiber from both the first and second zones whereby the fourth zone has a hairy characteristic.

10. The geocomposite of claim 1 wherein the net structure is a drainage net.

11. The geocomposite of claim 1 wherein the net structure is a geogrid.

* * * * *